United States Patent [19]

Shear

[11] Patent Number: 4,989,351

[45] Date of Patent: Feb. 5, 1991

[54] SNOWTHROWER PLATFORM

[76] Inventor: Walter J. Shear, 1430 McClellan St., Schenectady, N.Y. 12309

[21] Appl. No.: 498,428

[22] Filed: Mar. 26, 1990

[51] Int. Cl.[5] ..... E01H 5/09

[52] U.S. Cl. ..... 37/242; 37/244; 280/32.7; 180/11

[58] Field of Search ..... 37/196, 197, 241, 242, 37/244; 280/32.7; 180/11, 12, 13

[56] References Cited

U.S. PATENT DOCUMENTS

| | | | |
|---|---|---|---|
| 773,559 | 11/1904 | Freeman et al. | 280/32.7 |
| 3,336,042 | 8/1967 | Southall | 180/12 |
| 4,010,507 | 3/1977 | Johnson | 280/32.7 X |
| 4,096,920 | 6/1978 | Heyn | 180/11 |
| 4,756,101 | 7/1988 | Friberg et al. | 37/244 |
| 4,828,282 | 5/1989 | Pinto | 280/32.7 |

*Primary Examiner*—Randolph A. Reese
*Assistant Examiner*—Arlen L. Olsen

[57] ABSTRACT

A wheeled platform towable behind a snowthrower to apply a downward force on the traction wheels of the snowthrower. The person operating the snowthrower stands on the platform so that a portion of his/her weight is applied to a towbar that extends from the snowthrower to the platform. The front end of the towbar exerts a downward force on the rear end of the snowthrower.

7 Claims, 1 Drawing Sheet

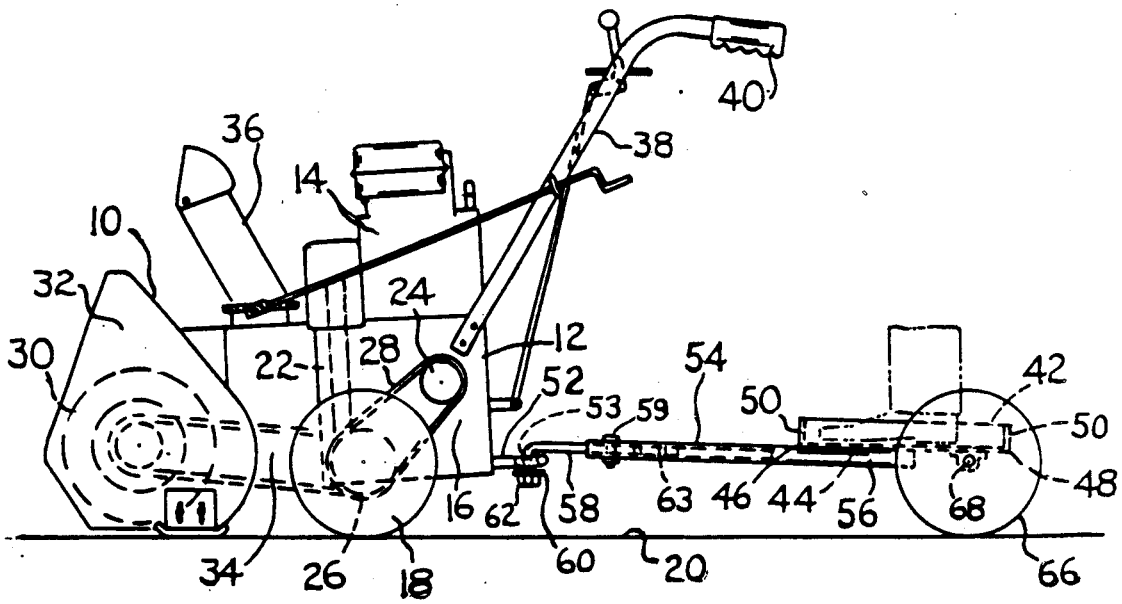
40
38
36
14
10
32
24
30
22
28
12
52
54
42
53
59
50
50
48
16
62
58
63
46
44
56
68
34
26
18
60
20
66

SNOWTHROWER PLATFORM

BACKGROUND AND SUMMARY OF THE INVENTION

This invention relates to snowthrowers of the walk-behind type, especially to snowthrowers having engine-driven traction wheels for propelling the snowthrower along the surface requiring a snow-removal action.

When the snow is wet or packed down the traction wheels or chute structure on conventional self-propelled snowthrowers may tend to ride up on the snow surface, rather than digging into the snow and staying on the pavement. This tendency of the traction wheels to ride up on packed snow tends to lift the auger so that the auger is unable to penetrate the full snow layer depth.

My invention contemplates the use of a small wheeled platform towed behind the snowthrower. The person operating the snowthrower stands on this platform, instead of walking behind the snowthrower. The person's weight bears down on the platform, which applies a downward force on the snowthrower traction wheels in front of the platform. I have found the use of such a wheeled platform to be effective for appreciably increasing the penetration and tractive effect of the traction wheels on the snowthrower. The effective downward force can be varied by shifting one's feet forwardly or rearwardly on the platform surface.

THE DRAWINGS

The FIGURE is a side elevational view of a snowthrower having a wheeled platform of the present invention attached thereto.

DESCRIPTION OF A PREFERRED EMBODIMENT OF THE INVENTION

The single FIGURE of the drawing shows a conventional two stage snowthrower 10 of the walk-behind type. The snowthrower includes a chassis 12 that supports an internal combustion engine 14 in the space above a transmission 16. Two traction wheels 18 are located outboard fom the chassis for moving the snowthrower along ground surface 20. These two traction wheels are located equidistantly form the longitudinal motion axis of the snowthrower (parallel to the plane of the paper in FIG. 1).

Engine 14 delivers power to transmission 16 by means of a vertical belt 22 extending within the chassis; the belt is trained around pulleys attached to the engine drive shaft and the transmission input shaft. A transmission output shaft carries a pulley (or sprocket) 24 that is radially aligned with a pulley (or sprocket) 26 carried on the support shaft for traction wheels 18. A belt (or chain) 28 is trained around the pulley (sprocket) pair to deliver power to the traction wheels 18.

At its front end the snowthrower carries a rotary auger 30 within a frowardly facing housing 32. Pulleys (or sprockets) attached to the auger shaft and traction wheel shaft have a belt (or sprocket) 33 trained therearound for delivering engine power to the auger. Other power-delivery arrangements can be employed between the engine and auger. The auger will typically include two helical auger sections rotatable around a transverse horizontal axis to move snow toward the central longitudinal axis of the snowthrower. An engine-driven blower is located in central space 34 to throw the collected snow upwardly through a discharge chute 36. Belt 22 (or another parallel belt) can be used to deliver engine power to the blower impeller.

The snowthrower is provided with two laterally spaced elongated handles 38 that extend angularly upwardly and rearwardly from chassis 12. The handles 38 terminate in hand grips 40. A person operating the snowthrower stands behind the snowthrower with his hands encircling handgrips 40.

Under the present invention the person operating the snowthrower stands on a wheeled platform 42 located directly behind the snowthrower. Wheeled platform 42 comprises an essentially flat rectangular panel 44 having a front end 46 and a rear end 48. An upstanding flange 50 extends upwardly from panel 44 along each of its four edges (i.e. the front edge, the rear edge, and the two side edges). The purpose for flange 50 is to force the person to stand with his feet entirely within the plan dimension of the panel (without having either foot extending beyond the front edge or rear edge of the panel). The flange also acts to prevent the person's foot from slipping off the panel. As further anti-slippage insurance, the panel upper surface can have a carpet or anti-slip facing material adhered thereon.

A towing connector 52 is attached to the rear end of snowthrower 10. A cooperating tow bar 54 extends forwardly from platform 42 for rotary articulated attachment to connector 52. Towing connector 52 preferably comprises an eyebolt arranged with its eye portion 53 in a horizontal plane, i.e. facing upwardly behind chassis 12. Tow bar 54 comprises an elongated hollow tube 56 rigidly affixed to the underside of panel 44, and an L-shaped rod 58 extending frowardly from the tube.

Rod 58 has its long leg portion extending into tube 56 as a snug wobble-free fit. A bolt 59 extends through aligned openings in the rod and tube so that the rod and tube form a rigid towbar assembly. The short leg of the L-shaped rod extends downwardly through the eye portion 53 of eyebolt 52; a washer 60 and nut 62 (or their equivalent) can be used to prevent upward displacement of the L-shaped rod out of the eyebolt opening. The connection between tow bar 54 and eyebolt 52 is a relatively loose connection, such that the towbar can pivot in a vertical plane and also in a horizontal plane (around the axis of the eye). Such an arrangement forms an articulation joint between the snowthrower and the trailing platform, whereby the snowthrower can be turned to the left or to the right without any binding between connector 52 and the towbar. Steering is accomplished by selective hand pressure on hand grips 40.

The horizontal leg of L-shaped rod 58 has a number of holes 63 extending therethrough at spaced points therealong. By removing bolt 58 and shifting the rod in or out of tube 56 the bolt can be extended through a different set of holes in the tube and rod. This procedure can be used to adjust the effective length of the towbar 54 so as to bring platform 42 closer to, or further away from, handgrips 42, according to the position considered most comfortable for the person operating the snowthrower.

Platform 42 comprises two laterally spaced rotary ground wheels 66 having an axle 68 attached to the underside of panel 44 near its rear end 48. The person operating the snowthrower stands with his feet on panel 44. The location of axle 68 near the rear end of panel 44 (and far away from the panel front end 46) forces the person to stand so that his weight (center of gravity) is located forwardly from the axle axis. This causes towbar 54 to apply a downward force on connector 52, thereby augmenting the downward force already applied to traction wheels 18 by the weight of the snowthrower components. The increased traction resulting from this additional downward force enables the traction wheels to better penetrate hard snow encountered by the traction wheels.

The distance from the panel front end 46 to the panel rear end 48 is preferably in a range of between fourteen inches and twenty inches, i.e. greater than one shoe length but less than two shoe lengths. A panel length of about fifteen inches is preferred. Axle 68 is located about three inches in front of the panel rear end 48. This arrangement forces the person to stand so that his weight is partially applied as a downward force onto the snowthrower traction wheels 18, via towbar 54. By shifting his feet toward the front end of panel 44 the person will apply a greater downward force to the traction wheels 18. By shifting his feet rearwardly, i.e. toward axle 68, the person will apply a lesser downward force on traction wheels 18. The person can shift his feet as snow conditions may warrant the need for increased traction.

In some circumstances it may be necessary to operate the snowthrower without standing on platform 42, e.g. when making a very tight turn of the snowthrower through one hundred eight degrees, with minimal turnaround clearance space. Platform 42 may be constructed with a relatively small wheel 66 spacing, e.g. less than twenty inches. Also, the weight of the wheeled platform can be relatively small. These factors permit the person to readily move or shift the platform laterally away from obstructions with his foot, using only a relatively small force. The snowthrower can then be temporarily operated by a person standing on the ground alongside platform 42. Under most conditions the person can maneuver the snowthrower and wheeled platform through a complete turnaround action without dismounting from the platform. The platform is detachable from the snowthrower when so desired.

I claim:

1. In combination, a snowthrower of the walk-behind type, said snowthrower having a front end and a rear end spaced apart to form a longitudinal motion axis for the snowthrower, an engine, an engine-driven auger at the front end of the snowthrower, two engine-driven traction wheels located behind the auger, and two laterally-spaced elevated hand grips at the rear end of the snowthrower;

a towing connector extending from the rear end of the snowthrower on the snowthrower longitudinal axis;

a wheeled platform located directly behind the snowthrower;

and a towbar extending forwardly from the wheeled platform for rotary articulated attachment to said towing connector;

said wheeled platform comprising an essentially flat panel adapted to have a person stand thereon while operating the snowthrower; said flat panel having a front end and a rear end spaced apart to form a longitudinal motion axis normally in direct alignment with the snowthrower motion axis; said platform further comprising two laterally spaced ground wheels rotatably attached to said panel for motion around an axis transverse to the platform longitudinal axis; the ground wheel rotational axis being located relatively close to the rear end of the panel and relatively far away from the front end of the panel, so that the person is forced to stand with his weight displaced forwardly from the ground wheel rotational axis, whereby the person's weight produces a downward force on the traction wheels of the snowthrower.

2. The combination of claim 1, wherein the distance between the front and rear ends of the panel is greater than one shoe length but less than two shoe lengths.

3. The combination of claim 1, wherein the distance between the front and rear ends of the panel is approximately fifteen inches.

4. The combination of claim 3, wherein the ground wheel rotation axis is spaced forwardly from the panel rear end by a distance of approximately three inches.

5. The combination of claim 1, wherein the wheeled platform comprises an upstanding flange extending around the peripheral edge of the flat panel, whereby the person is forced to stand with his feet entirely within the plan dimension of the panel.

6. The combination of claim 1, wherein said towbar has an adjustable length.

7. The combination of claim 6, wherein said towing connector consists of an eye bolt; said towbar comprising a tube extending forwardly from the wheeled platform, and an L-shaped rod having one end portion thereof extending into the forward end of the tube, the other end portion of said L-shaped rod extending downwardly through the eye portion of said eye bolt.

* * * * *